US011952890B2

(12) United States Patent
Radicioni et al.

(10) Patent No.: US 11,952,890 B2
(45) Date of Patent: Apr. 9, 2024

(54) FLUID SAMPLING AND MEASURING ASSEMBLY AND METHOD

(71) Applicant: SAIPEM S.P.A., San Donato Milanese (IT)

(72) Inventors: Alessandro Radicioni, San Donato Milanese (IT); Giulio Monacchi, San Donato Milanese (IT); Elvira Aloigi, San Donato Milanese (IT)

(73) Assignee: SAIPEM S.P.A., San Donato Milanese (IT)

( * ) Notice: Subject to any disclaimer, the term of this patent is extended or adjusted under 35 U.S.C. 154(b) by 288 days.

(21) Appl. No.: 17/603,845

(22) PCT Filed: Apr. 17, 2020

(86) PCT No.: PCT/IB2020/053661
§ 371 (c)(1),
(2) Date: Oct. 14, 2021

(87) PCT Pub. No.: WO2020/212932
PCT Pub. Date: Oct. 22, 2020

(65) Prior Publication Data

US 2022/0235653 A1 Jul. 28, 2022

(30) Foreign Application Priority Data

Apr. 18, 2019 (IT) ..... 102019000006068

(51) Int. Cl.
*E21B 49/00* (2006.01)
*E21B 41/04* (2006.01)

(52) U.S. Cl.
CPC ..... *E21B 49/001* (2013.01); *E21B 41/04* (2013.01)

(58) Field of Classification Search
CPC ..... E21B 49/001; E21B 41/04
See application file for complete search history.

(56) References Cited

U.S. PATENT DOCUMENTS 8,430,168 B2 * 4/2013 Goodall ..... E21B 33/0385 166/344
9,068,436 B2 * 6/2015 Theron ..... E21B 49/08
(Continued)

FOREIGN PATENT DOCUMENTS

WO WO 2014/039959 A1 3/2014

OTHER PUBLICATIONS

Notification Concerning Submission, Obtention or Transmittal of Priority Document for International Application No. PCT/IB2020/053661 dated Aug. 14, 2020.
(Continued)

*Primary Examiner* — Aaron L Lembo
(74) *Attorney, Agent, or Firm* — Neal, Gerber & Eisenberg LLP

(57) ABSTRACT

A fluid sampling and measuring assembly has:

a sampling and measuring module configured to sample and analyse a fluid sample;

a picking module configured to contain the fluid sample;

at least one navigation module configured to navigate in the body of water;

and at least one interface module configured to hydraulically connect a sampling station, the sampling and measuring module and the picking module. The sampling and measuring module and the picking module are configured to be mechanically and hydraulically coupled to each other and to the sampling station to take and analyse the fluid sample and the picking module is configured to be coupled to the navigation module to transfer the fluid sample to an analysis laboratory.

23 Claims, 3 Drawing Sheets

(56) References Cited

U.S. PATENT DOCUMENTS

| | | | | |
|---|---|---|---|---|
| 9,080,425 | B2 * | 7/2015 | Zediker | B63G 8/001 |
| 9,322,747 | B2 * | 4/2016 | Boe | E21B 41/0007 |
| 9,389,158 | B2 * | 7/2016 | Angelescu | A61M 5/14276 |
| 9,772,261 | B2 * | 9/2017 | Angelescu | A61M 5/14248 |
| 9,869,613 | B2 * | 1/2018 | Hausot | A61M 5/14276 |
| 10,161,247 | B2 * | 12/2018 | Tvedt | E21B 47/10 |
| 10,408,040 | B2 * | 9/2019 | Angelescu | G01N 11/02 |
| 10,415,350 | B2 * | 9/2019 | Radicioni | E21B 43/0107 |
| 10,604,221 | B2 * | 3/2020 | Bonel | B63C 11/52 |
| 10,641,064 | B2 * | 5/2020 | Lazzarin | E21B 43/0107 |
| 10,830,692 | B2 * | 11/2020 | Wang | G01N 21/314 |
| 11,433,975 | B2 * | 9/2022 | Radicioni | B63B 22/021 |
| 11,618,870 | B2 * | 4/2023 | Angelescu | C12M 33/06 73/864.35 |
| 2010/0059221 | A1 | 3/2010 | Vannuffelen et al. | |
| 2010/0198547 | A1 * | 8/2010 | Mulligan | E21B 41/0007 702/100 |
| 2012/0275274 | A1 * | 11/2012 | Gochnour | E21B 47/14 367/134 |
| 2013/0025874 | A1 | 1/2013 | Saunders et al. | |
| 2013/0126179 | A1 | 5/2013 | Cumming et al. | |
| 2015/0204167 | A1 | 7/2015 | Skeels et al. | |
| 2015/0276463 | A1 * | 10/2015 | Milne | B63B 22/20 73/19.1 |
| 2016/0076353 | A1 * | 3/2016 | Berle | B03C 1/30 210/767 |
| 2017/0002651 | A1 | 1/2017 | Tvedt | |

OTHER PUBLICATIONS

International Search Report and Written Opinion for International Application No. PCT/IB2020/053661 dated Aug. 18, 2020.

PCT Direct Letter attached to the International Patent Application claiming the priority of patent application No. 102019000006068 dated Apr. 6, 2020.

* cited by examiner

FLUID SAMPLING AND MEASURING ASSEMBLY AND METHOD

PRIORITY CLAIM

This application is a national stage application of PCT/IB2020/053661, filed on Apr. 17, 2020, which claims the benefit of and priority to Italian Patent Application No. 102019000006068, filed on Apr. 18, 2019, the entire contents of which are each incorporated by reference herein.

TECHNICAL FIELD

This disclosure relates to a fluid sampling and measuring assembly.

In particular, this disclosure relates to a sampling and measuring assembly for sampling and measuring a fluid produced or processed or injected or transported inside an underwater facility for extracting and/or producing hydrocarbons from wells, which are made in the bed of the body of water and are integral parts of the underwater facility itself.

In the following description, "production of hydrocarbons" refers to the extraction of hydrocarbons, the processing of hydrocarbons, the processing of fluids related to the production of hydrocarbons, and the subsequent transportation thereof.

BACKGROUND

Underwater hydrocarbon production facilities can be located on a bed of a body of water or in intermediate positions depending on the well or well field configuration. In addition, underwater hydrocarbon production facilities can be positioned in relatively shallow water or relatively very deep water and in all geographical areas regardless of whether the environmental conditions are relatively mild or relatively extreme.

The recent technological developments of underwater devices suitable for operating at great depths, and the great interest of oil companies, have facilitated the feasibility of relatively complex systems, expanded the potential of underwater production facilities, and made it possible to put facilities that also contain active process elements in water, such as arranged on bed of the body of water, into production. The main underwater treatment processes are: single- or multi-phase pumping; compression and pumping of gaseous fluid; two-phase or three-phase separation (e.g., liquid/liquid, gas/liquid, solid/liquid, oil/water/gas); hydrocarbon or sea or reservoir water treatment; pumping and injection of water or gas into the well; and injection of chemicals.

Generally, in order to predict the behaviour of the underwater facility, mathematical models are developed that simulate the features of the underwater facility and the state of the hydrocarbon reservoir over time as a function of chemical, physical, and thermodynamic data.

In recent years, the complexity of mathematical models has increased due to the introduction on the underwater facility of underwater separation, pumping, and compression components, chemical additive injection technologies, and the exploitation of production products at the relatively extreme density limits, in particular low-density gases or oils with relatively high viscosity, low temperatures, and high pressures.

In order to provide solutions that accurately approximate reality, mathematical models require updated data provided by sensors/instruments permanently installed in the underwater facility and require an initial calibration that must be updated over time. In particular, said sensors/instruments make it possible to measure changes in the physical and thermodynamic properties of the fluid extracted from the hydrocarbon reservoir, such as temperature, pressure, gas/liquid fraction, water/liquid fraction, flow rate, which may change during the exploitation of the hydrocarbon reservoir.

U.S. Published Patent Application No. 2015/204167; U.S. Published Patent Application No. 2017/002651; U.S. Published Patent Application No. 2010/059221; PCT Patent Application No. WO 2014/039959; U.S. Published Patent Application No. 2013/025874; and U.S. Published Patent Application No. 2013/126179 describe underwater plants for sampling and/or analysing process fluids of an underwater hydrocarbon production plant.

If the fluid properties are not updated and accurate, mathematical models can produce relatively significant errors with negative consequences for the operability and efficiency of the underwater facility. It is therefore necessary to frequently measure some significant parameters and to define the mathematical models based on said significant parameters.

In general, sampling and measuring assemblies of this prior art cannot provide accurate statistical data on fluid properties.

SUMMARY

The purpose of this disclosure is to provide a fluid sampling and measuring assembly that mitigates certain of the drawbacks of certain of the prior art.

In accordance with this disclosure, a fluid sampling and measuring assembly for taking and analysing at least one fluid sample from at least one sampling station of an underwater hydrocarbon extraction and/or production facility is provided, the sampling and measuring assembly comprising:

- a sampling and measuring module configured to sample and analyse a fluid sample;
- a picking module configured to contain the fluid sample;
- at least one navigation module configured to navigate in the body of water; and
- at least one interface module configured to hydraulically connect the sampling station, the sampling and measuring module and the picking module;
  - wherein the sampling and measuring module and the picking module are configured to be mechanically and hydraulically coupled to each other and to the sampling station to take and analyse the fluid sample and the picking module is configured to be coupled to the navigation module to transfer the fluid sample to an analysis laboratory; and
  - the fluid sampling and measuring assembly comprising a first releasable or permanent connecting device configured to mechanically connect the interface module and the navigation module; a second releasable connecting device configured to connect the interface module and the sampling and measuring module or the sampling station mechanically, hydraulically, electrically, and for data exchange; and a second permanent connecting device configured to connect the interface module and the picking module mechanically, hydraulically, electrically and for data exchange.

It should be appreciated that in accordance with this disclosure, at least one of the sampling and measuring assembly modules can be used for the sampling and measuring operations at different sampling stations of the same underwater facility or of different underwater facilities.

In addition, the sampling and measuring assembly modules are configured to be variously connected and adapted to different types of underwater facilities and/or operating modes in executing the sampling and the measuring.

The sampling and measuring assembly makes it possible to measure and analyse the fluid with relatively high frequency; therefore it makes it possible to monitor changes in the properties of fluids within an underwater hydrocarbon production facility.

In addition, the sampling and measuring assembly makes it possible to measure in situ and, almost simultaneously, to take samples similar and/or identical to those on which measuring is performed so as to provide statistically significant data on the multiphase properties of the fluid and to monitor the reliability of the in situ measuring.

The sampling and measuring assembly can, advantageously, be reconfigured to relatively easily and quickly adapt itself to a particular underwater facility.

In summary, the sampling and measuring assembly is flexible, automated, and able to provide reliable information.

In particular, the navigation module comprises a remote operated vehicle ("ROV") and/or an autonomous underwater vehicle ("AUV"). Thus, the navigation module is remotely controlled and able to transfer one or more modules from one sampling station to a further sampling station and/or from the bed of the body of water to the surface and vice versa.

In particular, the sampling and measuring assembly comprises an underwater control module which is configured to control, implement, and manage fluid sampling and measuring operations and is connected to the sampling and measuring module and to a surface station for the transmission of signals related to the sampling and measuring operations. Thus, the sampling and measuring module is able to operate autonomously even in the absence of the other modules.

In particular, the sampling and measuring module comprises at least one first sensor configured to generate signals related to at least one chemical-physical-thermodynamic fluid characteristic and/or at least one second sensor configured to generate a signal related to the fluid flow rate, wherein, in certain embodiments, the second sensor comprises a Venturi tube. Thus, the sampling and measuring assembly is able to measure at least one chemical-physical-thermodynamic fluid characteristic and the fluid flow rate, and to provide the measurement results in almost real time. This makes it possible to perform assessments of the need to take fluid samples to be analysed in an equipped analysis laboratory.

In particular, the picking module comprises at least one container configured to contain the fluid sample.

It should be appreciated that in accordance with the at least one container, the fluid sample can be transported to an analysis laboratory in order to be analysed. The container enables the chemical-physical properties of the fluid sample to be preserved during transport.

In particular, the interface module is configured to mechanically and/or electrically connect, and/or connect for data exchange, at least two between the sampling station, the sampling and measuring module, the picking module and the navigation module. Thus, it is possible to connect the sampling and measuring module, the picking module, the sampling station, and the navigation module according to different configurations. Because the sampling and measuring assembly can be reconfigured according to the needs and configuration of the underwater hydrocarbon production facility and the operating modes of the sampling and measuring assembly, it is relatively cost-effective.

In particular, the sampling and measuring assembly comprises an analysis laboratory; the sampling and measuring module and the analysis laboratory being configured to perform measurements of pressure, volume, volume fractions, temperature, density, viscosity and salinity of the fluid sample.

It should thus be appreciated that in accordance with the analysis laboratory or to the sampling and measuring module, it is possible to perform measurements of the physical, chemical, and thermodynamic properties of the fluid sample.

In particular, the analysis laboratory is configured to perform compositional, thermodynamic, and microbiological analyses of the fluid sample and is an underwater or surface analysis laboratory. Thus, the compositional, thermodynamic, and microbiological analyses of the fluid sample can be performed in a plant that is relatively easily and quickly accessible to the benefit of sample conservation, avoiding subjecting the fluid sample to thermodynamic cycles that would alter its original properties.

In particular, the analysis laboratory comprises one chamber and/or gaps isolated from the outside environment and at least one micro-electro-mechanical system ("MEMS") and/or at least one micro-fluid chip and/or at least one miniature sensor arranged inside the isolated chamber and/or gaps.

Thus, the analysis laboratory is relatively small in size and is able to autonomously manage the fluid sample analysis processes.

It should be appreciated that the term "MEMS" refers to a set of mechanical, electrical, and electronic devices integrated in a highly miniaturised form on the same semiconductor material substrate, which combine the functions of sensors with the functions of actuators for process management.

In particular, at least one navigation module is configured to transport the picking module from the sampling station to the analysis laboratory, and to transport the picking module from the analysis laboratory to the sampling station. Thus, the containers are relatively quickly and easily transported.

In particular, the sampling and measuring module is mechanically and hydraulically coupled, in a permanent way, to the sampling station, the first permanent connecting device being configured to mechanically connect the interface module and the navigation module. Thus, it is necessary to set up a sampling and measuring module for each sampling station, while only one picking module is required, which can be coupled to all the sampling and measuring modules and transported by just one navigation module. In this configuration, picking is performed only when the picking module is coupled to the sampling and measuring module, while sampling may also be performed when the picking module is not coupled to the sampling and measuring module.

In particular, the sampling and measuring module is mechanically and hydraulically coupled in a permanent way to the sampling station, the first releasable connecting device being configured to mechanically connect the interface module and the navigation module. Thus, it is necessary to set up a sampling and measuring module for each sampling station, while only one picking module and only one navigation module is required for performing the sampling and measuring operations. In this configuration, it is possible to perform sampling and measuring in different time periods, even when the navigation module is not connected to the picking module.

In particular, the sampling and measuring assembly comprises a third permanent connecting device configured to connect the interface module and the sampling and measuring module mechanically, hydraulically, electrically, and for data exchange; the first permanent connecting device being configured to connect the interface module and the navigation module mechanically, electrically, and for data exchange. Thus, only one sampling and measuring module and one picking module are required, these being transported between the different sampling stations by one navigation module. In this configuration, the sampling and measurements are performed when the sampling and measuring module transported by the navigation module is connected to a sampling station.

In particular, the sampling and measuring assembly comprises a first navigation module; a second navigation module; a first interface module; a second interface module; a third permanent connecting device configured to connect the second interface module and the sampling and measuring module mechanically, hydraulically, electrically, and for data exchange; a fourth permanent connecting device configured to connect the second interface module and the first navigation module mechanically, electrically, and for data exchange; and a third releasable connecting device configured to connect the first interface module and the second interface module mechanically, hydraulically, electrically, and for data exchange; the first releasable connecting device being configured to mechanically connect the first interface module and the second navigation module. Thus, only one sampling and measuring module and one picking module are required, these being transported between the different sampling stations by one first navigation module. In this configuration, the sampling and measurements are performed when the sampling and measuring module, transported by the first navigation module, is connected to a sampling station. The second navigation module is configured to take the containers containing the fluid sample from the picking module and return the empty containers to the picking module.

In particular, the sampling and measuring assembly comprises a fourth releasable connecting device which enables a releasable mechanical coupling between the interface module and the analysis laboratory, a transfer of fluids from the picking module to the analysis laboratory, and a transfer of power and signals. Thus, the fluid sample can be transferred to the analysis laboratory relatively quickly and easily, without altering its chemical-physical properties.

Another purpose of this disclosure is to provide an underwater hydrocarbon production plant that mitigates at least one of the drawbacks of certain of the prior art.

According to this disclosure, is provided an underwater hydrocarbon production plant comprising a fluid sampling and measuring assembly as described above; and an underwater hydrocarbon extraction and/or production facility configured to couple with the sampling and measuring assembly.

It should be appreciated that in accordance with this disclosure, it is possible to perform hydrocarbon extraction and/or production operations so as to manage the production processes and to plan the maintenance and/or calibration of some components of the underwater facility on the basis of reliable information.

Another purpose of this disclosure is to provide a fluid sampling and measuring method that mitigates at least one of the drawbacks of certain of the prior art.

According to this disclosure, a fluid sampling and measuring method for taking and analysing at least one fluid sample from at least one sampling station of an underwater hydrocarbon extraction and/or production facility is provided, the sampling and measuring method comprising:

- sampling and analysing a fluid sample using a sampling and measuring module coupled to a sampling station;
- preserving a fluid sample using at least one container in a picking module coupled to the sampling and measuring module;
- hydraulically connecting the sampling station, the sampling and measuring module, the picking module, and an interface module;
- transferring at least one fluid sample and/or at least one between the sampling and measuring module, the picking module and the interface module, via a navigation module, to an analysis laboratory;
- uncoupling the sampling and measuring assembly from the sampling station;
- coupling the sampling and measuring assembly to a further sampling station; and
- repeating in sequence the previous steps.

With this method, measurements can be performed at the same time as sampling so that these measurements are related to and statistically significant of the multiphase properties of the fluid and the degree of reliability of the in situ measurements is known.

In addition, it is possible to eliminate some types of flow rate meters, such as multiphase flow rate meters, installed downstream of each underwater well, as this method makes it possible to obtain the same information provided by said types of flow rate meters.

In particular, the method involves uncoupling the picking module from the sampling and measuring module; and transferring the picking module, and related container, to an analysis laboratory via the navigation module.

BRIEF DESCRIPTION OF THE FIGURES

Other characteristics and advantages of this disclosure will become clear from the following description of the non-limiting embodiments thereof, with reference to the accompanying figures, wherein.

DETAILED DESCRIPTION

Figure 1:
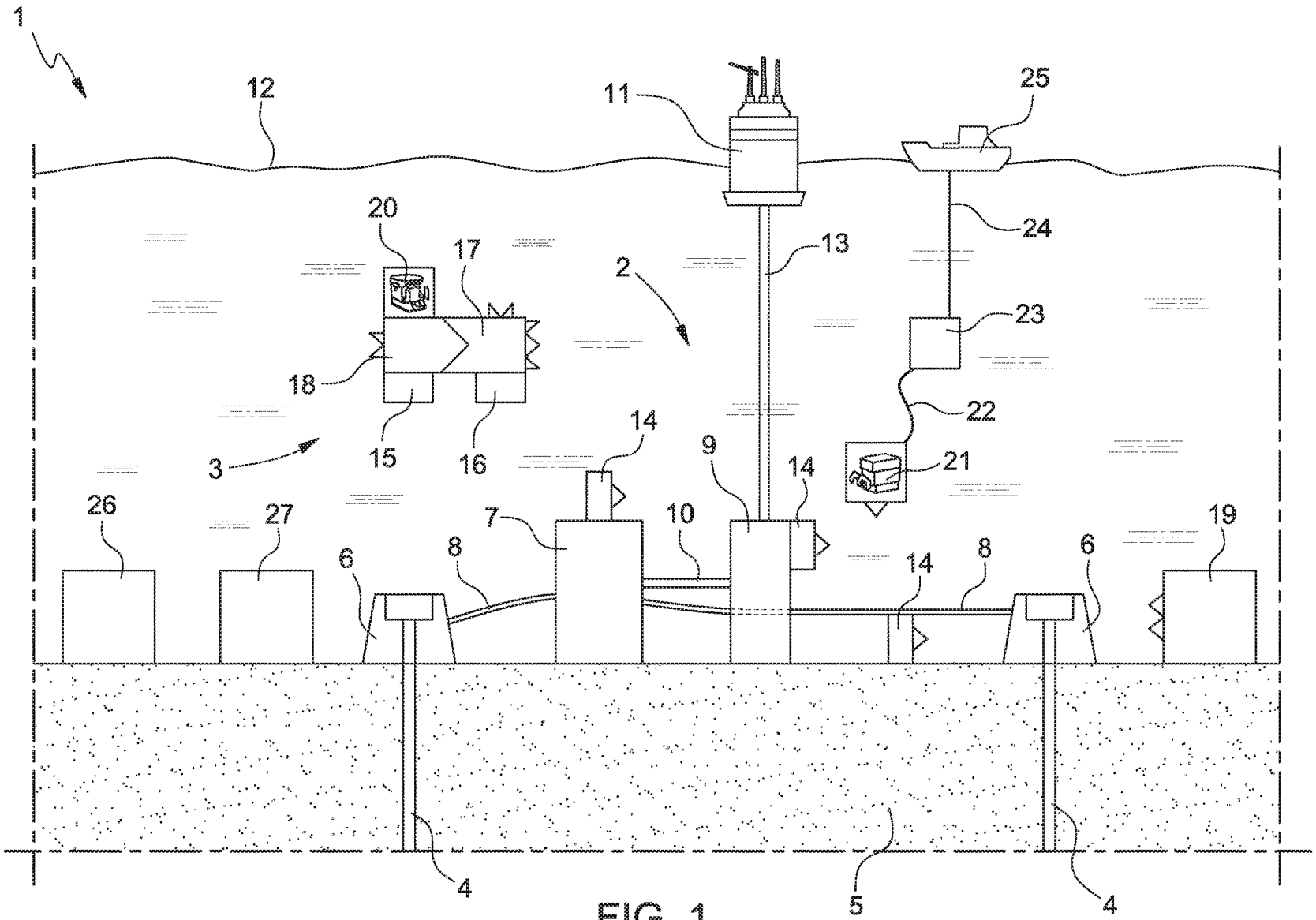
FIG. 1 is a schematic representation of an underwater hydrocarbon production plant comprising an underwater hydrocarbon production facility and a sampling and measuring assembly made in accordance with a first embodiment of this disclosure.

With reference to FIG. 1, the number 1 indicates, as a whole, an underwater hydrocarbon extraction and production plant 1. The underwater plant 1 comprises an underwater facility 2 configured to extract and produce hydrocarbons and a sampling and measuring assembly 3 of a process fluid of the underwater facility 2.

In the context of this description, the term "process fluid" refers to a fluid produced or processed or transported to the surface or injected into the underwater facility during hydrocarbon extraction and/or production operations. In the following description, this process fluid will simply be referred to by the term "fluid".

In the case illustrated in FIG. 1, the underwater facility 2 comprises two wells 4 for the extraction of hydrocarbons, from a bed 5 of a body of water; for each well 4, a well head 6 which is positioned on the bed 5 of the body of water at the corresponding well 4; a collector 7; for each well head 6, a pipeline 8 which hydraulically connects the well head 6 to the collector 7 enabling fluid to flow; an underwater process station 9; a pipeline 10 that hydraulically connects the collector 7 and the underwater process station 9; a surface station 11 which partially emerges from the surface 12 of the body of water; and a pipe 13 which enables the surface station 11 and the underwater process station 9 to be connected. In particular, the pipe 13 hydraulically connects the surface station 11 and the underwater process station 9 to enable fluid to flow and enables the exchange of signals between the surface station 11 and the underwater process station 9 and the transfer of power from the surface station 11 to the underwater process station 9 to power a control system and an electrical system (not shown in the figures).

According to alternative embodiments (not illustrated in the figures), the underwater facility comprises a spool tree coupled to a corresponding wellhead for each well.

The underwater facility may comprise a plurality of collectors and a plurality of pipelines for each wellhead.

In addition, the surface station can be set up on land. In this configuration, the pipe extends in a vertical direction and connects the surface station to the underwater process station or to a collector. The underwater facility 2 comprises a plurality of sampling stations 14, located at specific points of the underwater facility 2 and configured to be mechanically and hydraulically connected to the sampling and measuring assembly 3. In the case illustrated, the underwater facility 2 comprises three sampling stations 14, respectively, at the pipeline 8, at the collector 7, and at the underwater process station 9.

In the case illustrated in FIG. 1, the sampling and measuring assembly 3 comprises a sampling and measuring module 15 configured to sample and analyse a fluid sample; a picking module 16 configured to contain the fluid sample; an interface module 17; and an interface module 18.

The interface modules 17 and 18 are configured to be coupled with each other and to connect the sampling and measuring module 15 and the picking module 16 enabling power distribution and signal exchange.

The sampling and measuring assembly 3 comprises an analysis laboratory 19 which is equipped to perform chemical-physical analysis on the fluid samples taken. The analysis laboratory 19 can be set up in the surface station 11 (in accordance with an embodiment not illustrated in the figures), or in the body of water, relatively near or inside the underwater facility 2.

According to a variant of this disclosure, the analysis laboratory 19 is either integrated into one of the modules of the sampling and measuring assembly 3 or is an additional module of the sampling and measuring assembly 3.

In the case illustrated in FIG. 1, the analysis laboratory 19 is integrated into the underwater plant 1 and can be selectively coupled to the interface module 17.

The sampling and measuring assembly 3 comprises two navigation modules 20 and 21, respectively, an AUV which is coupled to the interface module 18 and configured to transport the sampling and measuring module 15 and the interface module 18 from one sampling station 14 to another sampling station 14; and an ROV which can be coupled to the interface module 17 and configured to take the picking module 16 with the fluid samples and transfer them to the analysis laboratory 19.

In particular, the ROV is connected via a cable 22 to a support unit 23, which, in turn, is connected via an umbilical cable 24 to a support boat 25.

It should be appreciated that the term "AUV" refers to a machine that can perform underwater operations autonomously and that does not need to be connected via cable to a surface control station. It should be further appreciated that the term "ROV" refers to a machine connected to a surface control station, via an umbilical connection cable, that can be remotely controlled by an operator to perform underwater operations of various kinds.

The sampling and measuring assembly 3 comprises an underwater base 26 configured to control the AUV and to store and recharge the AUV when it is not operative, and an underwater control module 27 which occupies a predefined position in the underwater facility 2, is configured to control, implement, and manage fluid sampling and measuring operations and is connected to the surface station 11 for transmitting signals related to the sampling and measuring operations and power transmission.

Figure 2:
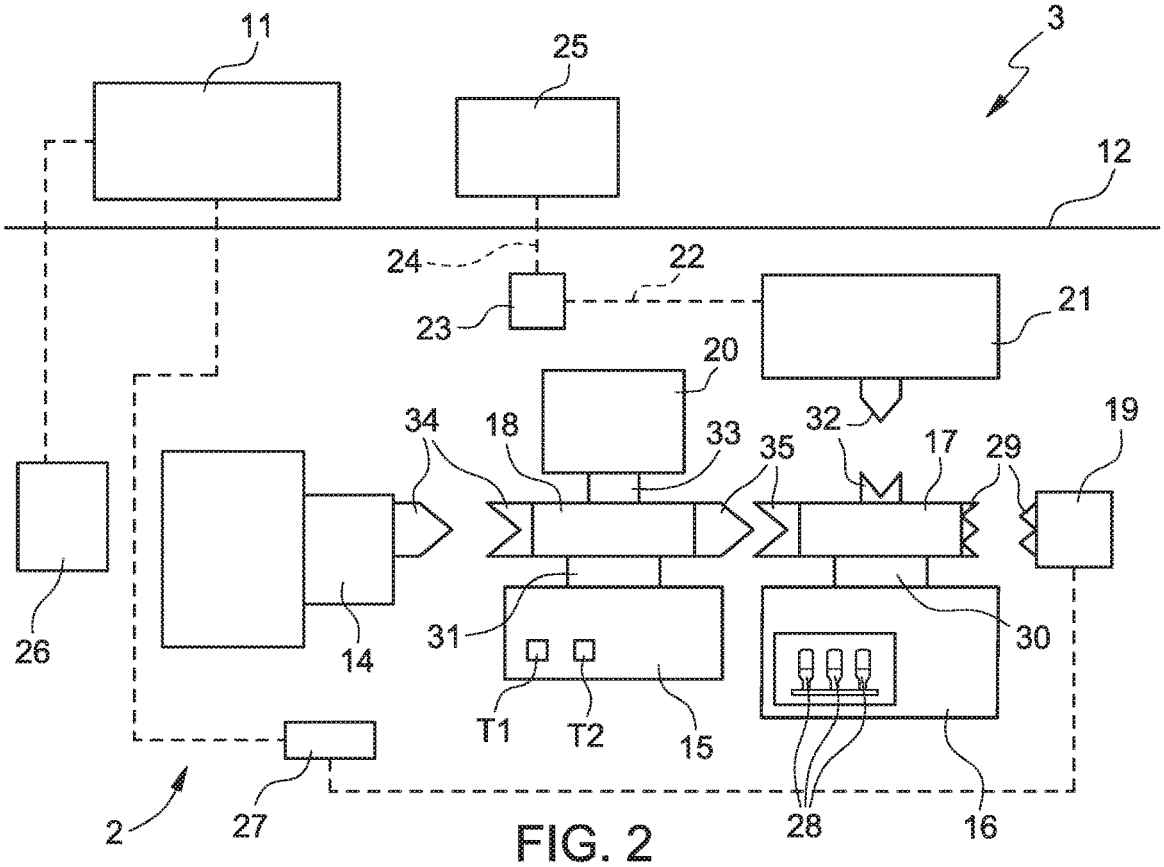
FIG. 2 is a schematic representation of the fluid sampling and measuring assembly of FIG. 1.

With reference to FIG. 2, the sampling and measuring module 15 comprises at least one first sensor T1 configured to generate signals related to the measurement of the chemical-physical-thermodynamic characteristics of the fluid and/or a second sensor T2 configured to generate a signal related to the measurement of the fluid flow rate, wherein, in certain embodiments, the second sensor T2 comprises a Venturi tube or another sensor that can provide the same type of measurement or a virtual system configured to predict the same measurement, such as a virtual flow meter.

According to a variant of this disclosure (not illustrated in the figures), the second sensor T2 is not part of the sampling and measuring module 15 but is comprised in the underwater facility 2.

The sampling and measuring module 15 is powered by the navigation module 20 and/or 21 and exchanges signals with the same navigation module 20 and/or 21.

The picking module 16 comprises at least one container 28 configured to contain the fluid sample and at least one device (not illustrated in the figures) configured to transfer the fluid sample from the interface module 17 so as to keep the fluid sample under the same temperature and pressure conditions as the main fluid flow.

The picking module 16 is powered by the navigation module 20 and/or 21 and exchanges signals with the same navigation module 20 and/or 21.

The navigation module 21 is connected via the cable 22 to the support unit 23, which is, in turn, connected to the support boat 25 via the umbilical cable 24, which makes it possible to transfer power and data to enable the navigation module 21 to be controlled by an operator located on the support boat 25.

The interface module 17 couples the picking module 16, the interface module 18, and the navigation module 21 enabling power to be distributed and signals to be exchanged between the picking module 16, the interface module 18, and the navigation module 21.

The interface module 18 couples the sampling and measuring module 15, the interface module 17, and the navigation module 20 enabling power to be distributed and signals to be exchanged between the sampling and measuring module 15, the interface module 17, and the navigation module 20.

The sampling and measuring assembly 3 comprises a releasable connecting device 29 to mechanically and hydraulically connect the interface module 17 and the analysis laboratory 19 to transfer fluids from the at least one container 28 to the analysis laboratory 19, and to exchange power and signals.

The analysis laboratory is powered by the navigation module 20 and/or 21 and/or exchanges signals with the same navigation module 20 and/or 21 and/or with the same underwater control module 27.

The underwater base 26 is configured to exchange data and signals between the surface station 11 and the navigation module 20 to control the navigation module 20.

The sampling and measuring assembly 3 comprises a permanent connecting device 30 configured to connect the interface module 17 and the picking module 16 mechanically, hydraulically, electrically or optically, for data exchange and power transfer; a permanent connecting device 31 configured to connect the interface module 18 and the sampling and measuring module 15 mechanically, hydraulically, electrically or optically, for data exchange and power transfer; a releasable connecting device 32 configured to connect the interface module 17 and the navigation module 21 mechanically, electrically or optically, for data exchange and power transfer; a releasable connecting device 33 configured to connect the interface module 18 and the navigation module 20 mechanically, electrically or optically, for data exchange and power transfer; a releasable connecting device 34 configured to connect the interface module 18 and the sampling station 14 mechanically, hydraulically, electrically and for data exchange; and a releasable connecting device 35 configured to connect the interface modules 17 and 18 mechanically, hydraulically, electrically or optically, for data exchange and power transfer.

According to certain embodiments of this disclosure (not shown in the figures), the interface module 17 and the picking module 16 are connected so that they can be released, the interface module 18 and the sampling and measuring module 15 are connected so that they can be released, and the navigation module 20 and the interface module 18 are connected so that they can be released.

In the configuration in FIG. 2, the sampling and measuring assembly 3 comprises only one sampling and measuring module 15, only one picking module 16, two interface modules 17 and 18, and two navigation modules 20 and 21 to perform sampling and measuring operations in the underwater facility 2.

In particular, the navigation module 20 transports the sampling and measuring module 15 from one sampling station 14 to another sampling station 14. The sampling only takes place when the interface module 17 is coupled to the other interface module 18, which is coupled to the sampling station 14.

At specific time intervals, the navigation module 21 takes the picking module 16 containing the containers 28 and transports it to the analysis laboratory 19 or to the surface.

According to an embodiment of this disclosure (not shown in the figures), each container 28 can be uncoupled from the picking module 16 and can be coupled to the analysis laboratory 19, and can be transported individually or together to other containers 28 by the navigation module 20 or 21.

Figure 3:
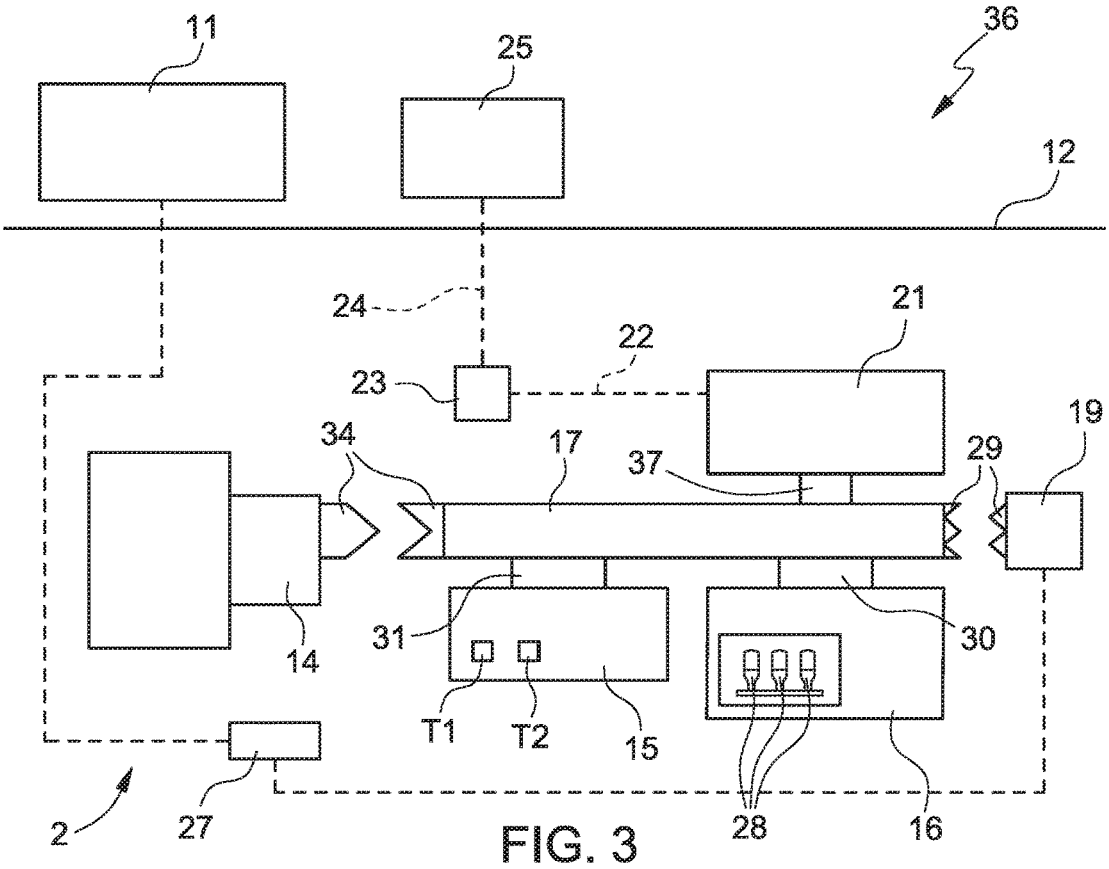
FIGS. 3 to 5 are schematic representations of sampling and measuring assemblies in accordance with additional embodiments of this disclosure.

With reference to FIG. 3, a second embodiment of the sampling and measuring assembly 36 is shown which differs from the first embodiment in that the interface module 18, the navigation module 20, and the underwater base 26 are omitted.

In addition, the sampling and measuring assembly 36 comprises a permanent connecting device 37 configured to connect the interface module 17 and the navigation module 21 mechanically, electrically, and for data exchange.

The sampling and measuring module 15 and the picking module 16 are powered by the navigation module 21 and exchange signals with the same navigation module 21.

The permanent connecting device 31 and the releasable connecting device 34 are configured to connect the interface module 17 and, respectively, the sampling and measuring module 15 and the sampling station 14 mechanically, hydraulically, electrically, and for data exchange.

According to certain embodiments of this disclosure (not shown in the figures), the interface module 17 and the navigation module 21 are connected so that they can be released, and the interface module 17 and the sampling and measuring module 15 are connected so that they can be released.

In the configuration of FIG. 3, the sampling and measuring assembly 36 comprises a single sampling and measuring module 15, a single picking module 16, a single interface module 17, and a single navigation module 21 to perform sampling and measuring operations in the underwater facility 2.

In particular, the navigation module 21 transports the sampling and measuring module 15 and the picking module 16, comprising the containers 28, from a sampling station 14 to another sampling station 14 or to the analysis laboratory 19 and vice versa or to the surface. The sampling only takes place when the interface module 17 is coupled to the sampling station 14.

Figure 4:
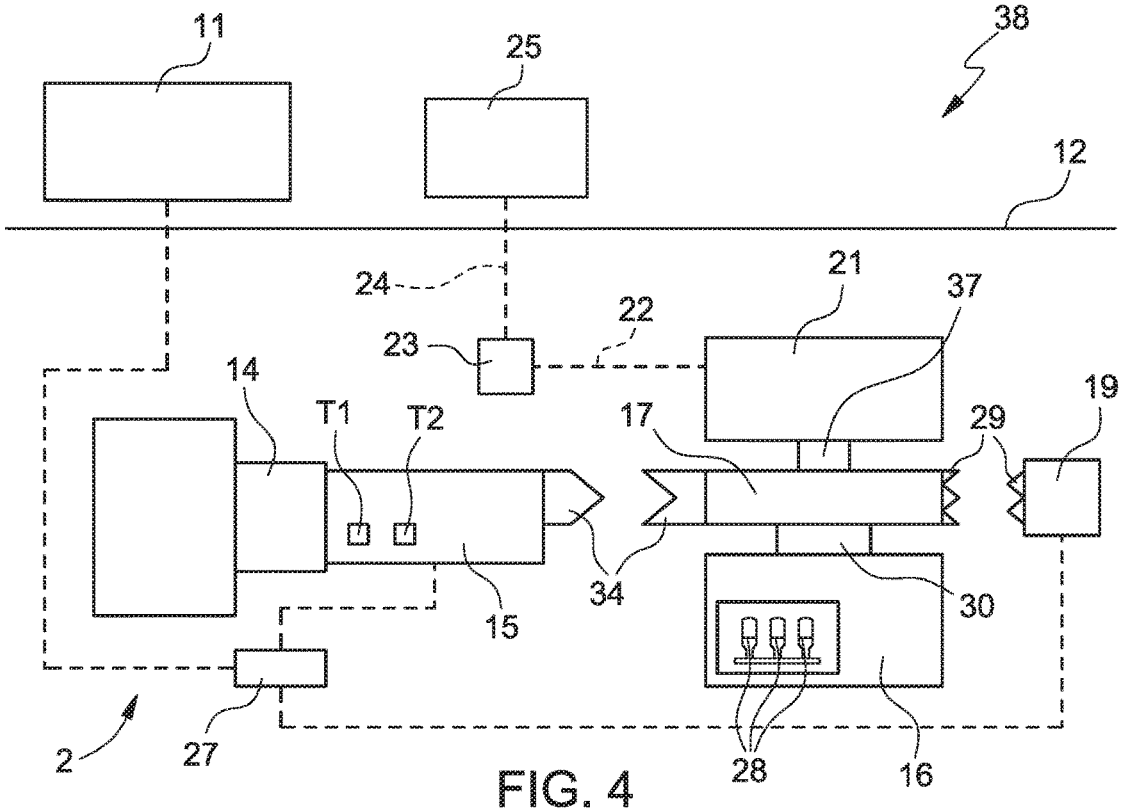

With reference to FIG. 4, a sampling and measuring assembly 38 is shown in accordance with a third embodiment and which differs from the second particular embodiment in that the sampling and measuring module 15 is permanently fixed to the sampling station 14 and, therefore, the permanent connecting device 31 is omitted.

The releasable connecting device 34 is configured to connect the sampling and measuring module 15 and the interface module 17.

The picking module 16 is powered by the underwater control module 27 and/or by the navigation module 21 and exchanges signals with the same underwater control module and/or navigation module 21.

In particular, the underwater control module 27 is configured to control and/or power the sampling and measuring module 15 and the analysis laboratory 19, and to receive data and/or signals concerning the sampling and measurements performed by the sampling and measuring module 15 and by the analysis laboratory 19. In this configuration, a sampling and measuring module 15 is required for each sampling station 14. In this configuration, just one picking module 16, one interface module 17, and one navigation module 21 are required to perform the sampling and measuring operations in the underwater facility 2.

In the configuration of FIG. 4, the navigation module 21 transports the picking module 16, comprising the containers 28, from one sampling station 14 to another sampling station 14 or to the analysis laboratory 19 and vice versa. The sampling and measuring are also performed when the navigation module 21 is not coupled to the interface module 17, while the fluid picking only takes place when the interface module 17 is coupled with the sampling and measuring module 15.

Figure 5:
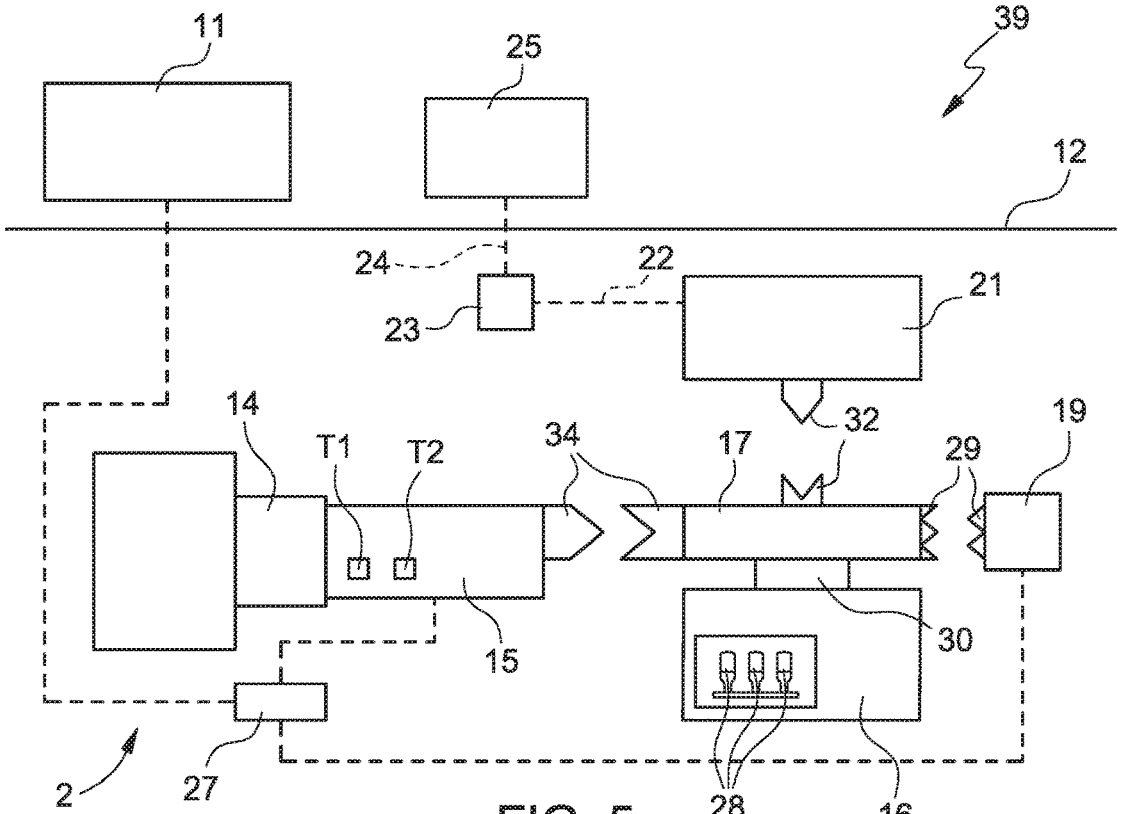

With reference to FIG. 5, a sampling and measuring assembly 39 is shown in accordance with a fourth embodiment and comprises one sampling and measuring module 15 for each sampling station 14; one picking module 16; one interface module 17; one navigation module 21 to perform sampling and measuring operations in the underwater facility 2; and a releasable connecting device 32 which is configured to mechanically connect the interface module 17 and the navigation module 21.

In the particular configuration of FIG. 5, the navigation module 21 moves from one sampling station 14 to another sampling station 14 to pick up the picking modules 16 with the containers 28 and transport them to the analysis laboratory 19 and vice versa. Sampling and measuring are also performed when the navigation module 21 is not coupled to the interface module 17.

The sampling and measuring modules 15 are powered by the underwater control module 27 and exchange signals with the underwater control module 27.

It is evident that variations can be made to this disclosure without departing from the scope of protection of the appended claims. That is, the present disclosure also covers embodiments that are not described in the detailed description above as well as equivalent embodiments that are part of the scope of protection set forth in the claims. Accordingly, various changes and modifications to the presently disclosed embodiments will be apparent to those skilled in the art.

The invention claimed is:

1. A fluid sampling and measuring assembly comprising:

a sampling and measuring module configured to sample and analyse a fluid sample from a sampling station of an underwater hydrocarbon facility;

a picking module configured to contain the fluid sample, wherein the sampling and measuring module and the picking module are configured to be mechanically and hydraulically coupled to each other and to the sampling station;

a navigation module configured to navigate in a body of water, wherein the picking module is configured to be coupled to the navigation module to transfer the fluid sample to an analysis laboratory;

an interface module configured to hydraulically connect the sampling station, the sampling and measuring module and the picking module;

a first connecting device configured to mechanically connect the interface module and the navigation module, the first connecting device being one of: a first releasable connecting device and a first permanent connecting device;

a second releasable connecting device configured to connect the interface module and one of: the sampling and measuring module and the sampling station, the connection being mechanical, hydraulic, electrical and for data exchange; and a second permanent connecting device configured to connect the interface module and the picking module, the connection being mechanical, hydraulic, electrical and for data exchange.

2. The fluid sampling and measuring assembly of claim 1, wherein the navigation module comprises at least one of an autonomous underwater vehicle and a remote operated vehicle.

3. The fluid sampling and measuring assembly of claim 1, further comprising an underwater control module configured to control, implement and manage fluid sampling and measuring operations and which is connected to the sampling and measuring module and to a surface station configured to transmit signals related to a sampling and measuring operation.

4. The fluid sampling and measuring assembly of claim 1, wherein the sampling and measuring module comprises at least one of: a first sensor configured to generate signals related to at least one chemical-physical-thermodynamic fluid characteristic, and a second sensor configured to generate a signal related to a fluid flow rate.

5. The fluid sampling and measuring assembly of claim 1, wherein the picking module comprises a container configured to contain the fluid sample.

6. The fluid sampling and measuring assembly of claim 1, wherein the interface module is configured to connect at least two of the sampling station, the sampling and measuring module, the picking module and the navigation module, the connection being at least one of: mechanical, electrical and for data exchange.

7. The fluid sampling and measuring assembly of claim 1, further comprising the analysis laboratory, wherein the sampling and measuring module and the analysis laboratory are configured to perform at least one of: a pressure measurement of the fluid sample, a volume measurement of the fluid sample, a volume fraction measurement of the fluid sample, a temperature measurement of the fluid sample, a density measurement of the fluid sample, a viscosity measurement of the fluid sample and a salinity measurement of the fluid sample.

8. The fluid sampling and measuring assembly of claim 7, wherein the analysis laboratory comprises one of an underwater laboratory and a surface analysis laboratory and is configured to perform at least one of: a compositional analysis of the fluid sample, a thermodynamic analysis of the fluid sample, and a microbiological analysis of the fluid sample.

9. The fluid sampling and measuring assembly of claim 7, wherein:

the analysis laboratory comprises a chamber and/or a gap isolated from an outside environment, and at least one of: a micro-electro-mechanical system, a micro-fluid chip, and a miniature sensor is located inside the chamber and/or the gap.

10. The fluid sampling and measuring assembly of claim 7, wherein the navigation module is configured to:

transport the picking module from the sampling station to the analysis laboratory, and transport the picking module from the analysis laboratory to the sampling station.

11. The fluid sampling and measuring assembly of claim 7, further comprising a third releasable connecting device which enables:

a releasable mechanical coupling between the interface module and the analysis laboratory, a transfer of fluids from the picking module to the analysis laboratory, and a transfer of power and signals.

12. The fluid sampling and measuring assembly of claim 1, wherein:

the sampling and measuring module is mechanically and hydraulically permanently coupled to the sampling station, and the first permanent connecting device is configured to mechanically connect the interface module and the navigation module.

13. The fluid sampling and measuring assembly of claim 1, wherein:

the sampling and measuring module is mechanically and hydraulically permanently coupled to the sampling station, and the first releasable connecting device is configured to mechanically connect the interface module and the navigation module.

14. The fluid sampling and measuring assembly of claim 1, further comprising a third permanent connecting device configured to connect the interface module and the sampling and measuring module, the connection being mechanical, hydraulic, electrical and for data exchange, wherein the first permanent connecting device is configured to connect the interface module and the navigation module, the connection being mechanical, electrical and for data exchange.

15. The fluid sampling and measuring assembly of claim 1, wherein:

the navigation module comprises a first navigation module, and a second navigation module;

the interface module comprises a first interface module and a second interface module;

the first releasable connecting device is configured to mechanically connect the first interface module and the second navigation module; and further comprising:

a third permanent connecting device configured to connect the second interface module and the sampling and measuring module, the connection being mechanical, hydraulic, electrical and for data exchange;

a fourth permanent connecting device configured to connect the second interface module and the first navigation module, the connection being mechanical, electrical and for data exchange; and a third releasable connecting device configured to connect the first interface module and the second interface module, the connection being mechanical, hydraulic, electrical and for data exchange.

16. An underwater hydrocarbon production plant comprising:

an underwater hydrocarbon facility; and a sampling and measuring assembly configured to couple with the underwater hydrocarbon facility, the sampling and measuring assembly comprising:

a sampling and measuring module configured to sample and analyse a fluid sample from a sampling station of the underwater hydrocarbon facility, a picking module configured to contain the fluid sample, wherein the sampling and measuring module and the picking module are configured to be mechanically and hydraulically coupled to each other and to the sampling station;

a navigation module configured to navigate in a body of water, wherein the picking module is configured to be coupled to the navigation module to transfer the fluid sample to an analysis laboratory;

an interface module configured to hydraulically connect the sampling station, the sampling and measuring module and the picking module;

a first connecting device configured to mechanically connect the interface module and the navigation module, the first connecting device being one of: a first releasable connecting device and a first permanent connecting device;

a second releasable connecting device configured to connect the interface module and one of the sampling and measuring module and the sampling station, the connection being mechanical, hydraulic, electrical and for data exchange; and a second permanent connecting device configured to connect the interface module and the picking module, the connection being mechanical, hydraulic, electrical and for data exchange.

17. A method comprising:

(i) sampling a fluid sample using a sampling and measuring module coupled to a first sampling station of an underwater hydrocarbon facility;

(ii) preserving the fluid sample using a container in a picking module coupled to the sampling and measuring module;

(iii) hydraulically connecting the first sampling station, the sampling and measuring module, the picking module and an interface module;

(iv) transferring, via a first navigation module and at least one of the sampling and measuring module, the picking module and the interface module, the fluid sample to an analysis laboratory;

(v) uncoupling the sampling and measuring assembly from the first sampling station;

(vi) coupling the sampling and measuring assembly to a second sampling station; and (vii) repeating, in sequence, (i) to (vi) at least once.

18. The method of claim 17, further comprising:

uncoupling the picking module from the sampling and measuring module; and transferring, via the first navigation module, the picking module to the analysis laboratory.

19. The method of claim 17, further comprising:

coupling the first navigation module to the picking module;

separating the first navigation module from the sampling and measuring module; and transferring, via the first navigation module, the picking module to the analysis laboratory.

20. The method of claim 17, further comprising:

transferring, via a second navigation module, the sampling and measuring module to a third sampling station;

coupling the second navigation module to the picking module;

taking, via the navigation module, the container containing the fluid sample;

uncoupling the second navigation module from the picking module; and transferring, via the second navigation module, the container to the analysis laboratory.

21. The method of claim 17, further comprising analysing the fluid sample in the analysis laboratory, the analysis comprising a repetition of an analysis performed in situ.

22. The method of claim 21, further comprising calibrating, based on the analysis, a plurality of parameters of a mathematical model simulating a behaviour of the underwater hydrocarbon facility.

23. The method of claim 21, further comprising calibrating, based on the analysis, at least one of: an underwater fluid flow meter and a fluid virtual flow meter.

* * * * *